US008174542B2

(12) United States Patent
Mori

(10) Patent No.: US 8,174,542 B2
(45) Date of Patent: May 8, 2012

(54) VIDEO DISPLAY APPARATUS

(75) Inventor: Makiko Mori, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1286 days.

(21) Appl. No.: 10/762,467

(22) Filed: Jan. 23, 2004

(65) Prior Publication Data

US 2004/0164995 A1 Aug. 26, 2004

(30) Foreign Application Priority Data

Feb. 26, 2003 (JP) ..... 2003-049804

(51) Int. Cl.
*G09G 5/00* (2006.01)

(52) U.S. Cl. ..... 345/690; 345/77; 345/76; 345/87; 345/204; 345/207; 345/89; 345/63

(58) Field of Classification Search ..... 345/211, 345/690, 207, 204
See application file for complete search history.

(56) References Cited

U.S. PATENT DOCUMENTS

| | | | | |
|---|---|---|---|---|
| 5,386,247 | A * | 1/1995 | Shafer et al. | 348/687 |
| 5,596,374 | A * | 1/1997 | Sumiyoshi et al. | 348/673 |
| 5,619,229 | A * | 4/1997 | Kumaki | 345/690 |
| 5,675,391 | A * | 10/1997 | Yamaguchi et al. | 348/565 |
| 5,734,423 | A * | 3/1998 | Wakabayashi | 348/189 |
| 5,757,343 | A * | 5/1998 | Nagakubo | 345/63 |
| 5,841,486 | A * | 11/1998 | Ando et al. | 348/673 |
| 5,990,940 | A * | 11/1999 | Hashimoto et al. | 348/184 |
| 6,307,575 | B1 * | 10/2001 | Matsushita | 715/788 |
| 6,307,596 | B1 * | 10/2001 | Cho | 348/563 |
| 6,331,843 | B1 | 12/2001 | Kasahara et al. | 345/63 |
| 6,348,952 | B1 * | 2/2002 | Jeong | 348/569 |
| 6,351,253 | B2 | 2/2002 | Kasahara et al. | 345/63 |
| 6,353,424 | B2 | 3/2002 | Kasahara et al. | 345/63 |
| 6,384,803 | B2 | 5/2002 | Kasahara et al. | 345/63 |
| 6,388,645 | B2 | 5/2002 | Kasahara et al. | 345/63 |
| 6,388,678 | B1 | 5/2002 | Kasahara et al. | 345/690 |
| 6,388,713 | B1 * | 5/2002 | Saiki et al. | 348/553 |
| 6,388,716 | B1 * | 5/2002 | Tsuzuki et al. | 348/687 |
| 6,400,346 | B2 | 6/2002 | Kasahara et al. | 345/63 |
| 6,603,104 | B1 | 8/2003 | Lee | 250/205 |

(Continued)

FOREIGN PATENT DOCUMENTS

CN 1290921 4/2001

(Continued)

*Primary Examiner* — Grant Sitta
(74) *Attorney, Agent, or Firm* — Fitzpatrick, Cella, Harper & Scinto

(57) ABSTRACT

A video display apparatus includes a converting circuit for executing nonlinear conversion for an input signal, a display brightness featured value detecting circuit for detecting a display brightness featured value indicating a brightness of a display screen from the input signal, and an adjustment circuit receiving an output of the converting circuit for adjusting the received signal on the basis of the display brightness featured value. In addition, a superimposing circuit superimposes a signal for displaying textual information to be superimposed or a signal for displaying an icon to be superimposed on the input signal. The superimposing circuit is placed on a stage after the adjustment circuit, and the display brightness featured value detecting circuit is placed on a stage after the converting circuit and after the superimposing circuit. The display brightness featured value detecting circuit detects a display brightness featured value indicating brightness of the display screen in a state that the textual information or the icon is superimposed, and an image is displayed on the basis of an output of the superimposing circuit.

9 Claims, 13 Drawing Sheets

U.S. PATENT DOCUMENTS

| | | | | |
|---|---|---|---|---|
| 6,690,388 | B2 * | 2/2004 | Kasahara et al. | 345/690 |
| 6,774,578 | B2 * | 8/2004 | Tanada | 315/169.4 |
| 6,795,053 | B1 * | 9/2004 | Funamoto et al. | 345/102 |
| 6,795,065 | B2 * | 9/2004 | Kang | 345/204 |
| 6,795,091 | B2 * | 9/2004 | Kim | 345/690 |
| 6,907,726 | B2 * | 6/2005 | Kim | 60/323 |
| 7,164,409 | B2 * | 1/2007 | Pasqualini et al. | 345/102 |
| 2001/0006377 | A1 | 7/2001 | Kasahara et al. | 345/60 |
| 2001/0006378 | A1 | 7/2001 | Kasahara et al. | 345/60 |
| 2001/0006379 | A1 | 7/2001 | Kasahara et al. | 345/60 |
| 2001/0011976 | A1 | 8/2001 | Kasahara et al. | 345/60 |
| 2001/0020938 | A1 | 9/2001 | Kasahara et al. | 345/211 |
| 2002/0036650 | A1 | 3/2002 | Kasahara et al. | 345/639 |
| 2002/0175908 | A1 * | 11/2002 | Ide | 345/211 |
| 2002/0180677 | A1 * | 12/2002 | Koyama | 345/88 |
| 2003/0030690 | A1 * | 2/2003 | Vega et al. | 347/22 |
| 2004/0056982 | A1 * | 3/2004 | Allender et al. | 348/626 |
| 2004/0201561 | A1 | 10/2004 | Funamoto et al. | 345/89 |
| 2004/0201562 | A1 | 10/2004 | Funamoto et al. | 345/89 |

FOREIGN PATENT DOCUMENTS

| | | |
|---|---|---|
| EP | 1 310 935 | 5/2003 |
| GB | 2 358 275 | 7/2001 |
| JP | 09-190160 | 7/1997 |
| JP | 11-231833 | 8/1999 |
| JP | 11-316564 | 11/1999 |
| JP | 2000-098961 | 4/2000 |
| JP | 2000-221941 | 8/2000 |
| JP | 2000-250463 | 9/2000 |
| JP | 2001-154643 | 6/2001 |
| JP | 2002-41007 | 2/2002 |
| JP | 2003-022044 | 1/2003 |
| JP | 2003-029689 | 1/2003 |
| JP | 2003-029693 | 1/2003 |
| WO | WO 99/30308 | 6/1999 |

* cited by examiner

VIDEO DISPLAY APPARATUS

BACKGROUND OF THE INVENTION

The present invention relates to a video display apparatus.

There has been known a video display apparatus that comprises an ABL circuit and/or a contrast adjustment circuit. There has particularly been known an ABL which controls the display apparatus so as to prevent an average display brightness on a display screen from becoming excessively high for the purpose of suppressing concentration of a beam and power consumption or for other purposes.

[Patent Document 1]

Japanese Patent Application Laid-Open No. 2000-221941

In Patent Document 1, a construction for performing the ABL is disclosed. In this construction, an automatic brightness control circuit is used to adjust a brightness level for pixel data for each pixel which are sequentially supplied from an A/D converter in order for an average brightness of an image to be displayed on a display screen of a PDP to come within a predetermined brightness range. The adjustment of brightness level here is carried out before the inverse gamma correction is performed under setting of a ratio of the number of light emissions in the respective sub-fields to an non-linearity.

In general, a video signal is subjected to a non-linear conversion such as a conversion of the 0.45th power of the signal as shown in FIG. 11, called as the gamma conversion, which is adapted to an input vs. light emission characteristic of a CRT display, assuming that the video signal is displayed by a CRT display apparatus, and the subjected video signal is transmitted or recorded. When such a video signal is displayed for displays having a linear input vs. light emission characteristic in a SED, FED, PDP or the like, an input signal is subjected to the inverse gamma conversion such as a conversion of the 2.2th power of the signal as shown in FIG. 12. If displaying based on other input vs. light emission characteristics is performed in an LCD device or the like, a conversion suitable to the display device is carried out.

FIG. 13 shows a block diagram of a video signal processing apparatus amounted on a typical video display apparatus using a display device such as SED, FED, PDP, LCD having a characteristic of light emission responsive to an input signal which is different from that of a CRT. Although an actual video signal processing apparatus is comprised of many other processing circuits, this figure shows only blocks relating to the present invention.

The video signal processing apparatus shown in FIG. 13 has an A/D converter 1001, a signal processing section 1002, an average brightness detecting section 1003 and a gain calculating section 1004. The A/D converter 1001 receives an analog input video signal s101 and outputs a digital video signal s102. The signal processing section 1002 receives the digital video signal s102, and subjects the received signal to a signal processing such as an inverse gamma conversion, brightness and chromaticity adjustments, an edge enhancement processing to output a display signal s103. The average brightness detecting section 1003 receives the digital video signal s102, and detects an average brightness for each frame to output an average brightness signal s104. The gain calculating section 1004 receives the average brightness signal s104 and outputs a brightness control signal s105.

The A/D converter 1001, signal processing section 1002, average brightness detecting section 1003 and gain calculating section 1004 respectively operates on the basis of various kinds of timing signals generated from a synchronization signal of the input video signal s101 by a timing control section, not shown.

However, in the configuration shown in FIG. 13, an average brightness is obtained by totaling values for the digital video signal s102, but nevertheless an image actually displayed in the display apparatus is originated from the display signal s103 obtained by subjecting the digital video signal s102 to the different signal processings including an inverse gamma conversion. Especially the inverse gamma conversion is intended to carry out a non-linear conversion such as the 2.2th power of the signal as shown in FIG. 12, and therefore the average brightness of the signal is significantly decreased, so that a one-to-one correspondence is collapsed between an average brightness of the digital video signals s102 and an average brightness of the display signal s103 that has been converted in the inverse gamma conversion. For these reasons, the average brightness signal s104 detected in the average brightness detecting section 1003 has some error with respect to an average brightness actually provided for display in the display apparatus, whereby accurate average brightness information could not been obtained.

SUMMARY OF THE INVENTION

The present invention has been made in order to overcome the problems of the prior art, its object is to realize a configuration which can suitably perform adjustment of an input signal in a video display apparatus carrying out a non-linear conversion.

A first invention that concerns the present application is arranged as follows. That is, it is directed to a video display apparatus comprises: a converting circuit for nonlinearly converting an input signal; a display luminance featured value detecting circuit for detecting a display luminance featured value indicating a brightness of a display screen from an input signal; and an adjustment circuit receiving an output of the converting circuit for adjusting the received signal on the basis of the display luminance featured value, the display luminance featured value detecting circuit is placed on a post stage of the converting circuit, the video display apparatus displaying an image on the basis of an output of the adjustment circuit.

DETAILED DESCRIPTION OF THE INVENTION

Figure 1:
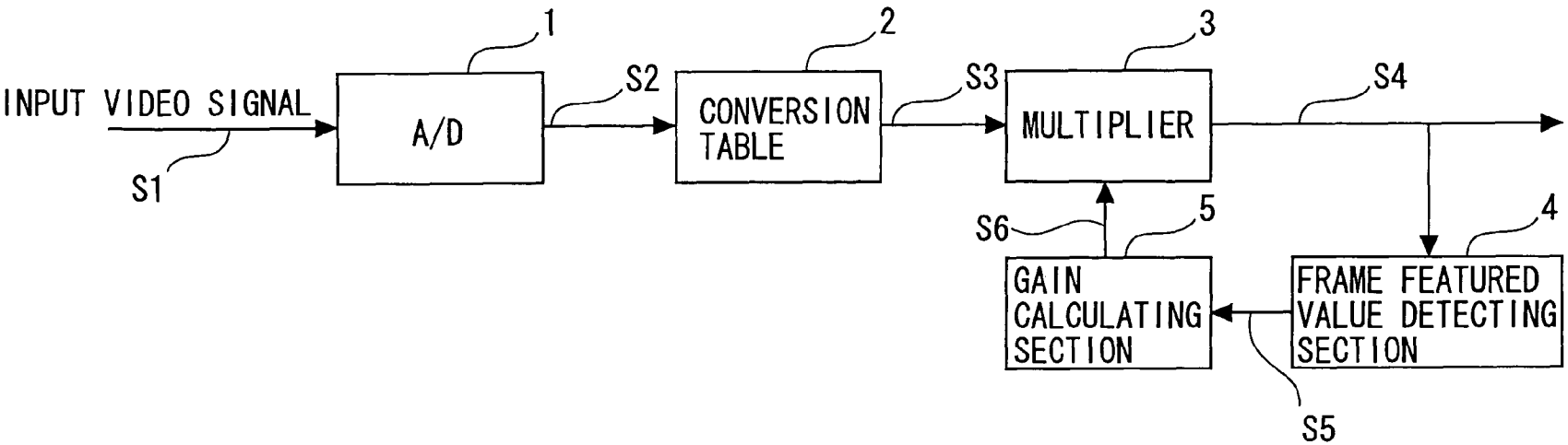
FIG. 1 is a block diagram of a video signal processing apparatus according to a first embodiment.

In the invention of the present application, a term "brightness" is used, but it is used as a term covering even a configuration in which gray-scale displaying is realized by visually summing brightness for a predetermined period in the case of displaying using a pulse-width modulation system (in the case of the pulse-width modulation, the predetermined period is modulated).

It should be noted that in the invention of the present application an adjustment circuit is supplied with an output of a converting circuit as its input signal, but there is no need to directly input the output from the converting circuit to the adjustment circuit and the output may be indirectly inputted thereto via other circuit (a circuit for executing a desired operation as necessary).

Various configurations can be adopted for preferred embodiments of a first invention of the present application.

The present application includes, as a second invention, a configuration wherein said adjustment circuit is an adjustment circuit for adjusting a received signal on the basis of a plurality of display luminance featured values which are sequentially detected in the first invention. Particularly, it is preferably possible to use a configuration in which display brightness featured values detected sequentially are regarded as a series of varying signals and which uses a value obtained by smoothing the varying signals, for example by means of carrying out a low-pass filtering processing for high frequency components of the varying signals to cut the high frequency components. Namely, the present application includes an invention intended to adopt an adjustment circuit for adjusting the input signal on the basis of a value obtained by smoothing high frequency components of said plurality of display brightness featured values. To put it concretely, the present application includes an invention intended to adopt an adjustment circuit for performing its adjustment based on a value obtained by subjecting said plurality of display brightness featured values to a filtering process, more specifically to a low-pass filtering process.

The present application includes, as a third invention, an invention using as said adjustment circuit an adjustment circuit for adjusting a received signal on the basis of a luminance control value relating to an adjustment of image quality in the first or second invention.

The present application includes, as a fourth invention, an invention wherein said display luminance featured value is a sum or average value of display signals for a predetermined period in any one of the first to third inventions.

The present application includes, as a fifth invention, an invention wherein said display luminance featured value is the number of signals of the display signals for a predetermined period which have a greater value than a predetermined value in any one of the first to third inventions.

The present application includes, as a sixth invention, an invention wherein said display luminance featured value is a sum or average value of display signals for each color for a predetermined period in any one of the first to third inventions.

The present application includes, as a seventh invention, an invention wherein said display luminance featured value is a sum or average value of luminance components of display signals for a predetermined period in any one of the first to third inventions.

Here, one frame period or one field period can preferably be used for the predetermined period in the inventions mentioned above.

The present application includes, as a eighth invention, an invention wherein said display luminance featured value is a statistical value of display signals in a specific area of one display screen in any one of the first or second inventions.

It is noted that a sum or average value of display signals or brightness components of the display signals, or a value detected from them for each color or the number of the signals having a greater value than a predetermined value can be used for the statistic value, as described before.

In short, as a display brightness featured value in the inventions of the present application, various kinds of values can be used as long as it is a value reflecting a degree of luminance shown during display operation.

Furthermore, as a ninth invention, the present application includes a configuration adopting the configuration of forming a plurality of display elements as pixels in the above-mentioned inventions. In particular, it may preferably be used a configuration in which a plurality of display elements are arranged in matrix.

That is, the invention of the present application can more preferably be used in a configuration in which a plurality of pixels are formed using a plurality of display elements in the above-mentioned inventions. More specifically, an electro-emission device, in particular a cold cathode device, an electroluminescence device, a plasma display device or a liquid crystal device can preferably be used for the display element. A configuration in which the display elements of any of these types are arranged in matrix can be used more preferably.

It should be noted that while the invention of this application is intended to place said display brightness featured value detecting circuit at a stage after said converting circuit, "place said display brightness featured value detecting circuit at a stage after said converting circuit" means that a signal reflecting a result of conversion in said converting circuit is inputted to the display brightness featured value detecting circuit as its input signal. To put it concretely, there can be adopted a configuration in which an output of the converting circuit is inputted to the display brightness featured value detecting circuit directly or indirectly, or a configuration in which the display brightness featured value detecting circuit receives an input signal obtained from a result of displaying based on an output of the converting circuit. For the latter, a preferred configuration can be adapted, in which e.g. an electro-emission device is used as a display element, and which detects an emission current value obtained from a result of driving the electro-emission device based on an output of said converting circuit and uses the detection result as an input signal for the display brightness featured value detecting circuit to output the display brightness featured value. For example, said emission current value can be detected as an amount of current flowing into an electrode provided with an electrical potential to accelerate electrons emitted from the electro-emission device. Furthermore, in addition to detecting the value of emission current from the electro-emission device, a result of detection of a value of current flowing in the display element may be used for an input signal of the display brightness featured value detecting circuit.

Although the respective circuits constituting the inventions of the present application are described above and below, these circuits can be constructed from a single or plural elements such as transistor and resistor. In addition, these circuits may be in integrated form and implemented as (an) integrated circuit(s).

Now the present inventions will be described in more detail with respect to embodiments shown in the drawings.

First Embodiment

Figure 13:
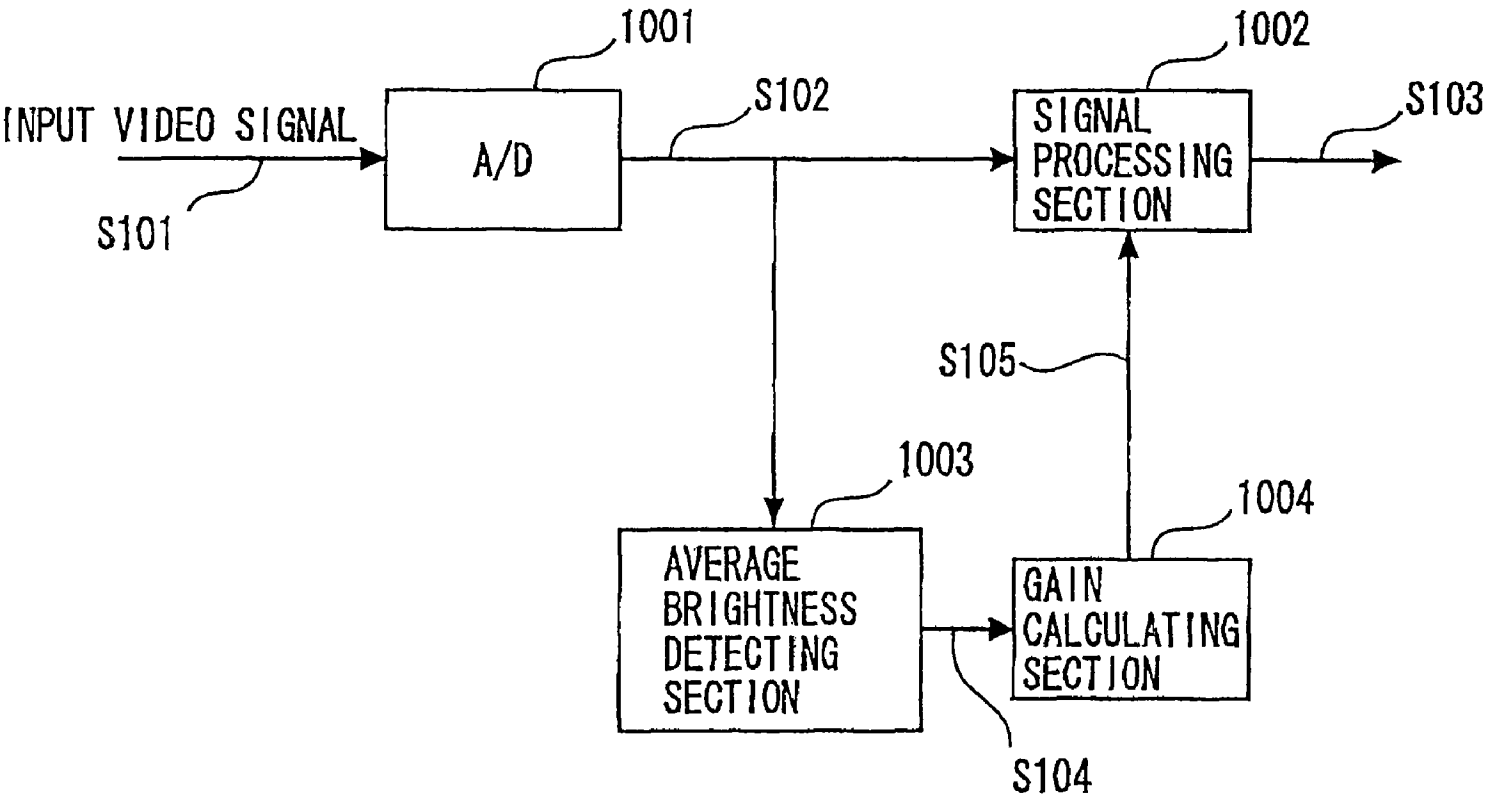
FIG. 13 (PRIOR ART)
FIG. 13 is a block diagram of a typical video signal processing apparatus.

FIG. 1 shows a configuration of a video signal processing apparatus applied to a video display apparatus according to a first embodiment of the present invention. FIG. 1 only shows extracted blocks corresponding to those in FIG. 13.

(Main Configuration of a Video Signal Processing Apparatus)

A video signal processing apparatus 100 comprises an A/D converter 1, a conversion table 2, a multiplier 3, a frame featured value detecting section 4 and a gain calculating section 5.

Figure 12:
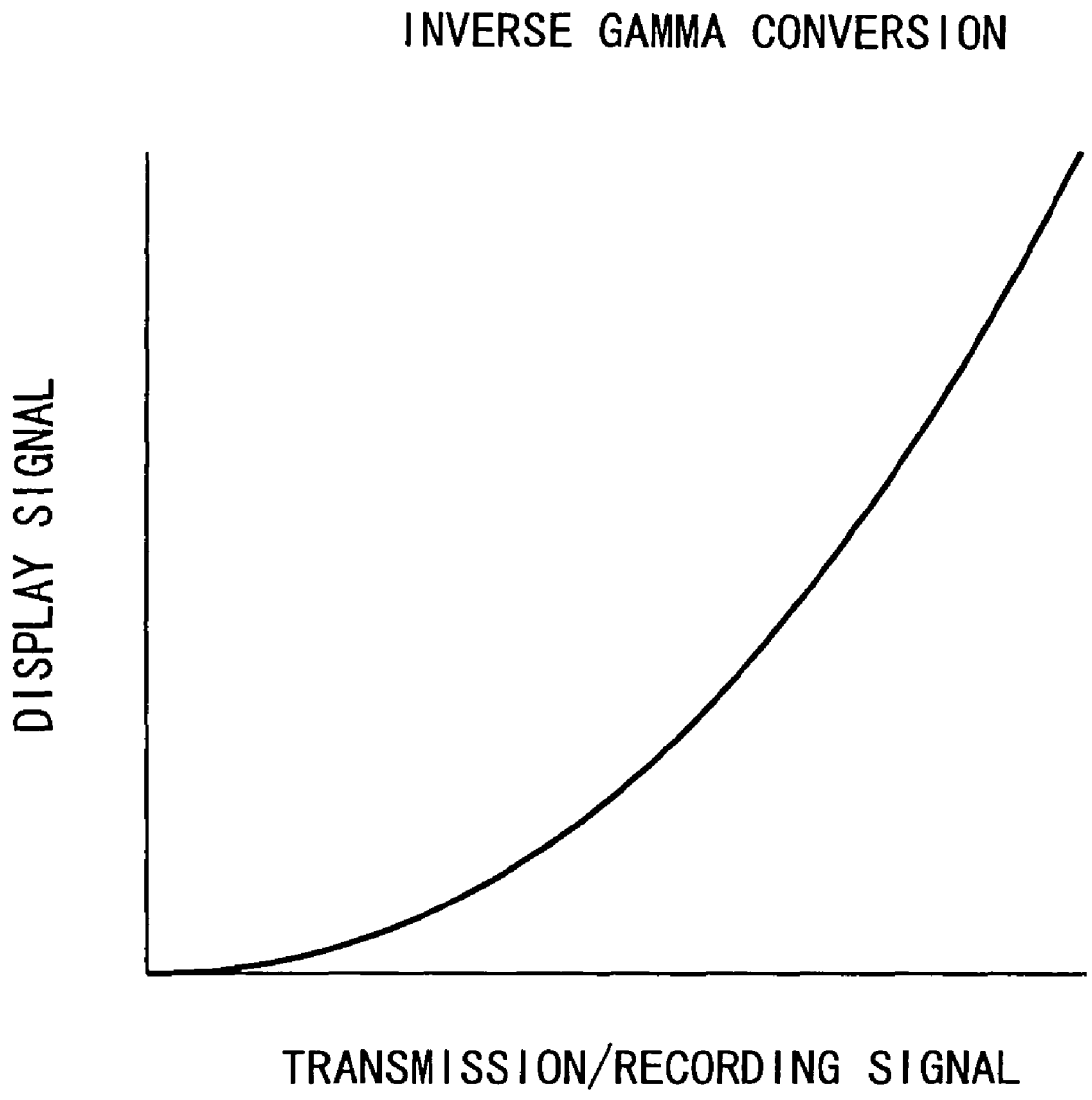
FIG. 12 is a graph for explaining an inverse gamma conversion.

The A/D converter 1 converts an input video signal s1 to a digital video signal s2. The video signal s1 here is a signal corresponding to a primary color in the applied display apparatus, such as R, G, B signal. When the video signal s1 is luminance and color-difference signals, it is converted into a primary color signal by using a color matrix circuit, not shown. The conversion table 2 as a converting circuit, which is comprised of a memory such as ROM and RAM, receives a digital video signal s2 outputted by the A/D converter 1 and addresses the memory using it as an input, and then stores the conversion result as data corresponding to each address so as to output a signal s3 that is obtained after the conversion. Much the same conversion characteristic as that in FIG. 12 is used as a conversion characteristic for the conversion table 2. The multiplier 3 multiplies the signal s3 outputted from the conversion table 2 by a gain s6 set by the gain calculating section 5, described later, to output a display signal s4. The frame featured value detecting section 4 as a display brightness featured value detecting circuit receives the display signal s4 outputted from the multiplier 3, and detects an average value of it for each frame to output an average brightness signal s5 that carries a display brightness featured value. The gain calculating section 5 receives the average brightness signal s5, and compares the received signal with a beforehand-determined reference brightness value to calculate a gain s6 by which the brightness can be suppressed when the average brightness exceed the reference brightness value and to make it an input to the multiplier 3. Herein, the multiplier 3 and the gain calculating section 5 constitutes an adjustment circuit.

The A/D converter 1, conversion table 2, multiplier 3, frame featured value detecting section 4 and gain calculating section 5 respectively operate on the basis of different kinds of timing signals generated based on a synchronization signal of the input video signal s1 by a timing control section, not shown.

Now, of a video signal processing method in the present embodiment, a way of computing a gain in the gain calculating section 5 will be described below.

Assuming that B(t) is an average brightness for the current frame detected in the frame featured value detecting section 4 and BO is a beforehand determined reference brightness value, the gain calculating section 5 determines a gain G(t) using Formula 1.

[Numeral Formula 1]

$$G(t)=\mathrm{MIN}(G(t-1)\times B0/B(t),1) \quad \text{(Formula 1)}$$

In this formula, G(t−1) is a gain outputted previously, and MIN(a, b) is a function for obtaining lower one of a and b in value.

By multiplying the signal s3 by this G(t) in the multiplier 3, an average brightness of the display signal s4 displayed in the display apparatus is suppressed to a vale of the reference brightness value or less.

In the above description the frame featured value detecting section 4 detects an average value of a display signal for each frame, but a statistical value such as a sum of the display signals, the number of display signals having a greater value than a predetermined value, an average or sum value for each color, or a sum or average value of brightness components of the display signal for each color may be detected to output the detection result to the gain calculating section 5. In addition, one display screen may be divided into a plurality of areas, and the statistical value as mentioned above may be used for each area or for only the central area.

As described above, according to the present invention, a frame featured value is obtained from an actual display signal, and thereby it is possible to acquire an accurate brightness estimate value and to quickly converge on it, so that a good ABL control can be achieved even in the case of a moving picture whose average brightness varies successively.

(Whole Configuration of the Video Display Apparatus)

Figure 2:
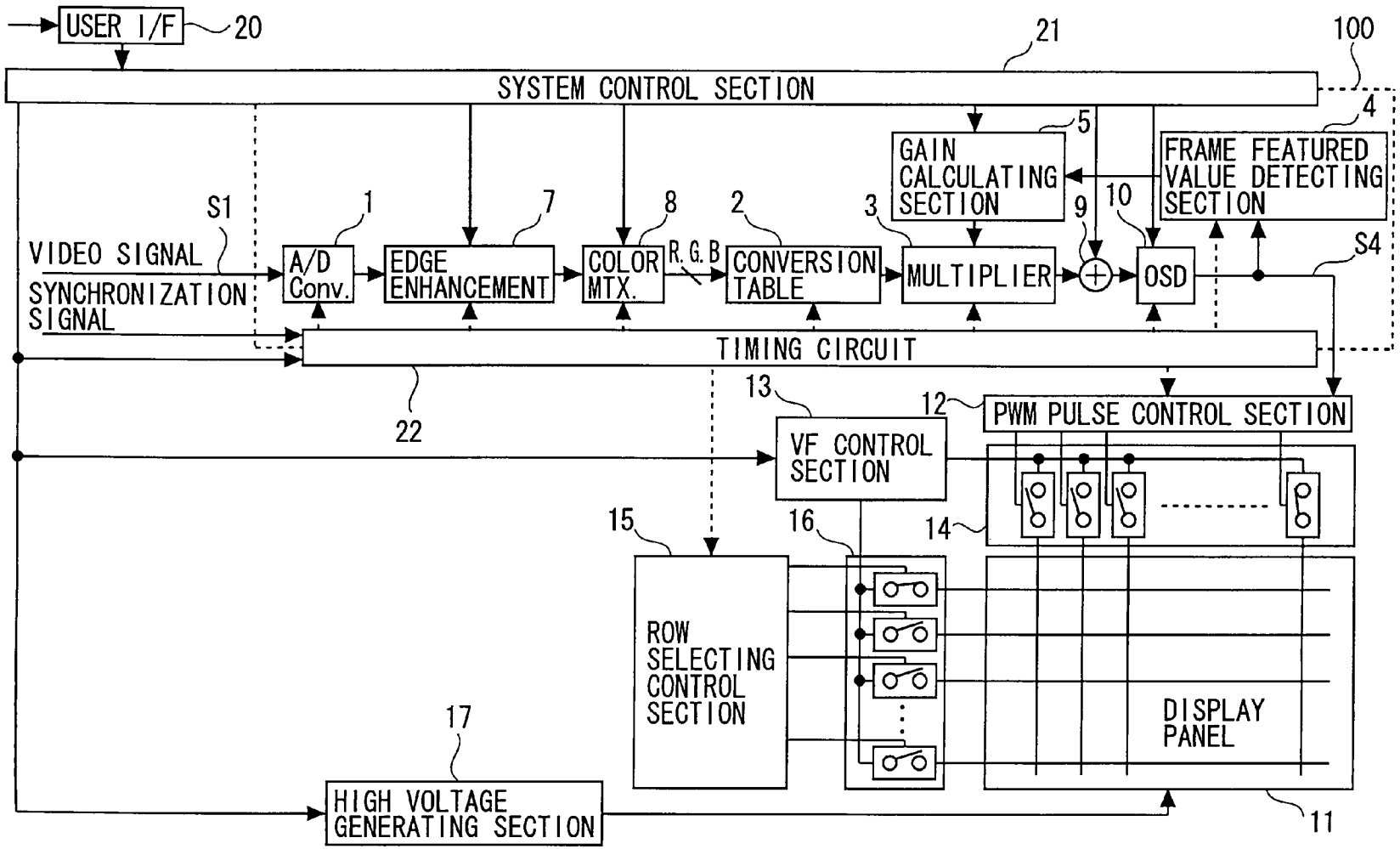
FIG. 2 is a block diagram showing a configuration of a video display apparatus according to the present invention.

FIG. 2 shows a configuration of the whole of a video display apparatus according to the present invention. In this figure, a block surrounded by a chain line is the video signal processing apparatus 100 described with reference to FIG. 1, and a construction omitted in FIG. 1 is also shown. Description about the similar configuration to that in FIG. 1 will be omitted with the same reference symbols being given hereto.

The video signal processing apparatus 100 has an edge enhancement circuit 7, a color matrix converting circuit 8, an adder 9 and a textual information superimposing circuit 10 in addition to the configuration shown in FIG. 1.

The edge enhancement circuit 7 executes a processing for enhancing an edge of the input video signal. The color matrix converting circuit 8 converts the input video signal into an R, G and B signals when the input video signal is luminance and color-difference signals. However, when the input video signal is R, G, B signals, the color matrix converting circuit 8 does not execute that conversion processing. The adder 9 adds an offset value set by the system control section 21 to the respective signals. The processing executed by the adder 9 is mainly used in brightness adjustment or the like. The textual information superimposing circuit 10 is called as "OSD" (On Screen Display) in general, and superimposes textual information and/or an icon or more on the video signal in accordance with the settings of the system control section 21. The textual information superimposing circuit 10 is placed on a stage after the multiplier 3 and adder 9 so as not to be influenced by them, because one can feel visual wrongness if luminance of the superimposed text or icons is changed due to the ABL control and/or the adjustment of image quality. In recent years, information to be superimposed in the textural information superimposing circuit 10 has ranged over a large area and has a greater ratio of its occupying area to a whole of the display signal, and so the frame featured value detecting section 4 is placed on a stage after the textual information superimposing circuit 10.

The video display apparatus has a display panel 11, a PWM pulse control section 12, a Vf control section 13, a column line switch section 14, a row selecting control section 15, a row low switch section 16, a high voltage generating section 17, a user interface circuit 20, a system control section 21 and a timing control section 22, in addition to the video signal processing apparatus 100.

A SED panel has been used as the display panel 11 in this example, which comprises in a thin evacuated envelope: a multi-electron source in which surface conductive type electro-emission elements that are a number of electron sources e.g., cold cathode elements are arranged on a substrate; and an image forming member for forming an image based on irradiation with electrons, with the multi-electron source and image forming member being opposed to each other. The electro-emission elements are coupled in wiring in simple matrix by row-directional wiring electrodes and column-directional wiring electrodes, and make light emission by accelerating the electrons emitted from the element selected with a bias of the row/column electrode by means of a high voltage to cause the accelerated electrons to impinge on a fluorescent material. The constitution and manufacturing method for a SED panel is disclosed in detail in Japanese Patent Application Laid-Open No. 2000-250463 in the present applicant's name, etc.

The PWM pulse control section 12 converts the display signal to a driving signal suitable to the display panel 11. The Vf control section 13 controls a voltage for driving the elements arranged in the display panel 11. The column line switch section 14 is comprised of switch means such as transistors, and applies a driving output from the Vf control section 13 to a column electrode of the panel for a period of a PWM pulse outputted from the PWM pulse control section 12 for each horizontal scanning period (row selecting period). The row selecting control section 15 generates a row selecting pulse for driving the elements on the display panel 11. The row line switch section 16 is composed of switch means such as transistors, and outputs a driving output from the Vf control section 13 to the display panel 11 in accordance with a row selecting pulse outputted from the row selecting control section 15. The high voltage generating section 17 generates an accelerating voltage for accelerating the electrons emitted from the electro-emission elements arranged on the display panel 11 to cause the electrons to impinge on the fluorescent material.

By the user interface circuit 20, adjustment values for image quality are inputted to the system control section 21, which includes a contrast, brightness, etc. The system control section 21 monitors and controls the whole system, while it performs operational settings of the respective blocks of the video signal processing apparatus 100 in accordance with the input video signal and the adjustment value for image quality, inputted from the user interface circuit 20. The timing control section 22 applies various kinds of timing signals for operation of the respective blocks to the respective blocks in the video signal processing apparatus 100 and the circuits 12 to 16 for driving the column lines and row lines on the basis of a synchronization signal of the input video signal and/or the setting values from the system control section 21.

(Video Display Operation)

During a normal video displaying operation, an input video signal s1 is inputted to the video signal processing apparatus 100 and converted to a display signal s4. The display signal s4 is converted from serial to parallel for each horizontal scanning period (row selecting period) and PWM-modulated for each column. The PWM-modulated pulse is outputted to the column line switch section 14.

Row selection of the display panel 11 is performed in such a manner that the row selecting control section 15 generates a selecting pulse to the row line switch section 16 from a signal obtained by sequentially shifting a start pulse for each row selecting period, the start pulse being timed to the beginning of a vertical effective displaying period.

As described above, the display panel 11 is driven to display an image.

It should be noted that the A/D converter 1 is not necessary if the input video signal is a digital video signal.

The present embodiment has been described with reference to a SED panel as a display apparatus, but it can be applied to any types of FED, PDP and electroluminescence devices, etc. regardless of a display panel structure itself.

Furthermore, in the present embodiment, the case of digital signal processing has been described, but the same functionality may be realized in an analog circuit, where A/D converter 1 will become unnecessary while the individual processing circuits may be realized in analog circuitry.

Second Embodiment

Figure 3:
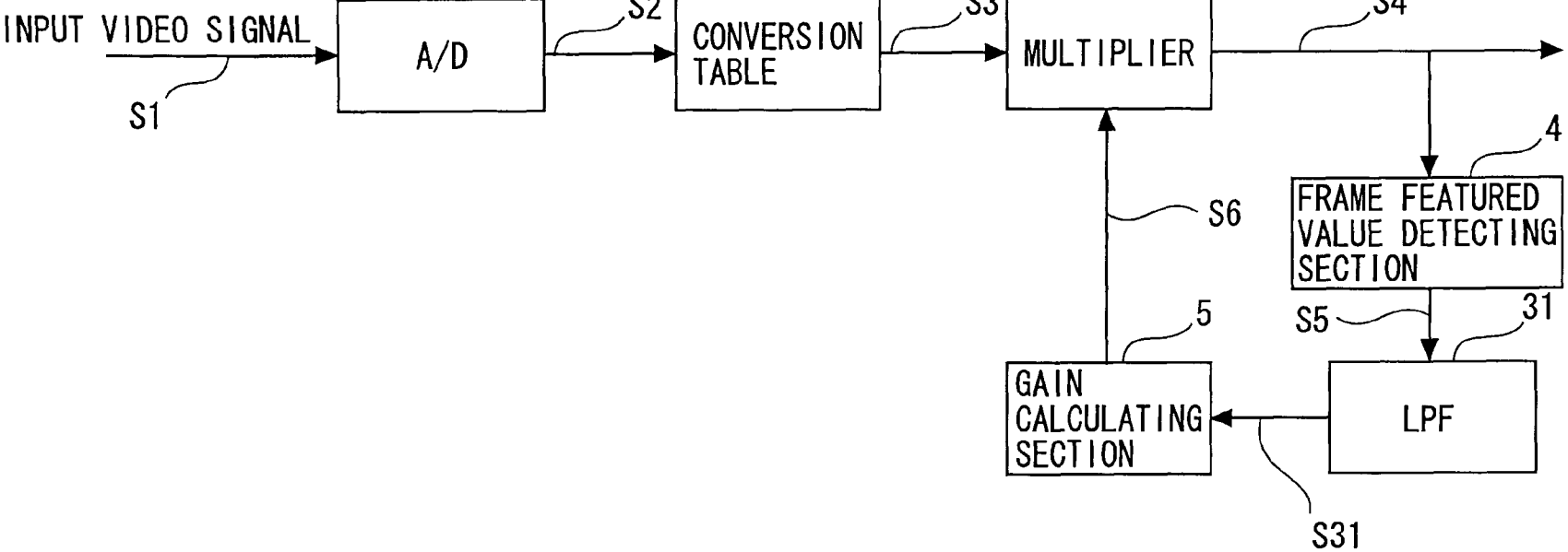
FIG. 3 is a block diagram of a video signal processing apparatus according to a second embodiment.

FIG. 3 shows a configuration of a video signal processing apparatus applied to a video display apparatus according to a second embodiment of the present invention. Of a whole configuration of the video display apparatus, a construction other than that of the video signal processing apparatus 100 is the same as that of FIG. 2. The similar construction to that in FIG. 1 is given the same reference symbols and its description will be omitted.

In the first embodiment, the output of the frame featured value detecting section 4 is inputted to the gain calculating section 5. However, the present embodiment is arranged to input the average brightness signal s5 to a low-pass filter (LPF) 31 and apply its output s31 to the gain calculating section 5. Herein, the low-pass filter 31, multiplier 3 and gain calculating section 5 constitute an adjustment circuit.

The low-pass filter 31 cuts high frequency components of the average brightness signal s5 so as to suppress a variation of the gain s6 due to precise change of the input video in frames, resulting in prevention of visual interference.

In this way, the present embodiment accomplishes the above-mentioned advantages by a configuration in which the low-pass filter 31 is added to the video signal processing apparatus 100 according to the first embodiment shown in FIG. 1. However, use of the configuration shown in FIG. 1 can also lead to substantially the same results as those in the video display signal processing apparatus shown in FIG. 3 by using Formula 2 instead of Formula 1 in the processing of the gain calculating section 5.

[Numeral Formula 2]

$$G(t)=\mathrm{MIN}(G(t-1)\times B0/f(B),1) \qquad \text{(Formula 2)}$$

In this formula, f(x) is a function corresponding to a characteristic of the low-pass filter 31, wherein a plurality of average brightnesses for the past frames are received and the filtered output is obtained.

Third Embodiment

Figure 4:
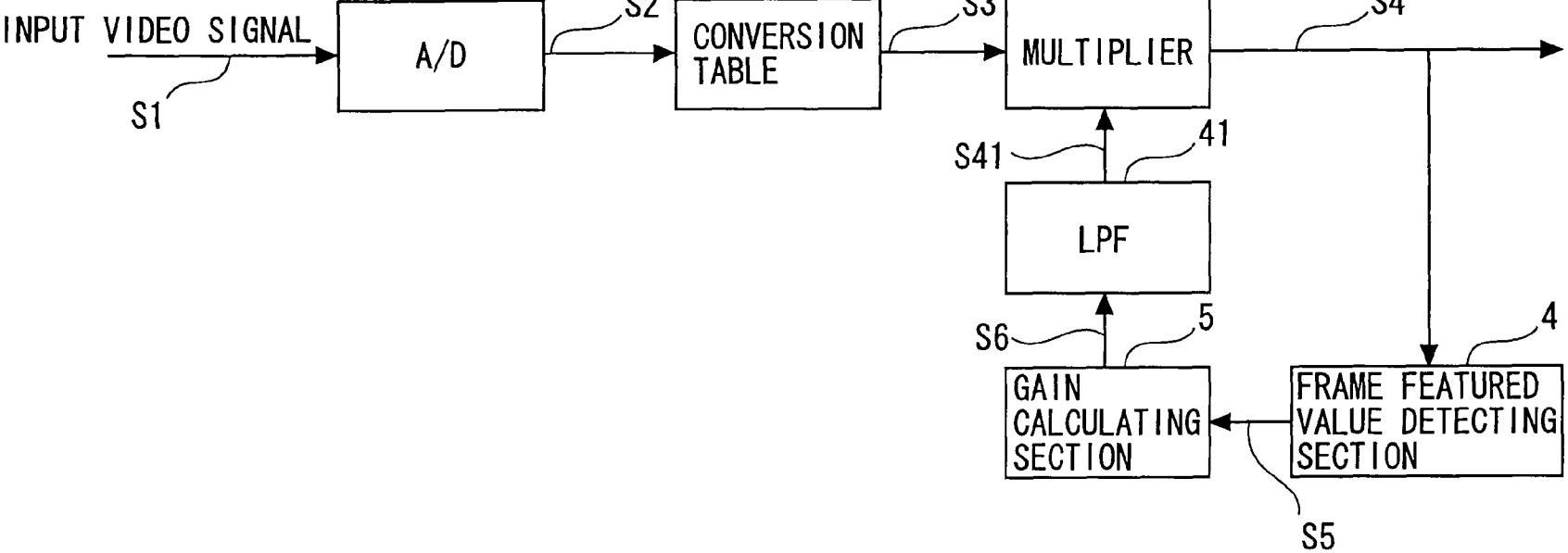
FIG. 4 is a block diagram of a video signal processing apparatus according to a third embodiment.

FIG. 4 shows a configuration of a video signal processing apparatus applied to a video display apparatus according to a third embodiment of the present invention. Of the configuration of the whole video display apparatus, a configuration other than that of the video signal processing apparatus 100 is the same as that of FIG. 2. The similar construction to that in FIG. 1 is given the same reference symbols and its description will be omitted.

In the first embodiment the output of the gain calculating section 5 is inputted to the multiplier 3, but the present embodiment is arranged to input the gain s6 to the low-pass filter 41, and then to input the output s41 to the multiplier 3. Herein, the gain calculating section 5, low-pass filter 41 and multiplier 3 constitute an adjustment circuit.

The low-pass filter 41 cuts high frequency components of the gain s6 so as to suppress an influence due to precise change of the input video in frames, resulting in prevention of visual interference feeling.

In this way, the present embodiment accomplishes the above-mentioned advantages on the basis of a configuration in which the low-pass filter 41 is added to the video signal processing apparatus 100 according to the first embodiment shown in FIG. 1. However, use of the configuration shown in FIG. 1 can also lead to the same results as those in the video display signal processing apparatus shown in FIG. 4 by using Formula 3 instead of Formula 1 in the processing of the gain calculating section 5.

[Numeral Formula 3]

$$G(t)=\mathrm{MIN}(G'(t-1)\times B_0/B(t),1) \quad \text{(Formula 3)}$$

$$G'(t)=f'(G)$$

In this formula, f'(x) is a function corresponding to a characteristic of the low-pass filter 41, where a plurality of gains G for the past frames are received to obtain the filtered output. G'(t) is outputted to the multiplier 3.

Fourth Embodiment

Figure 5:
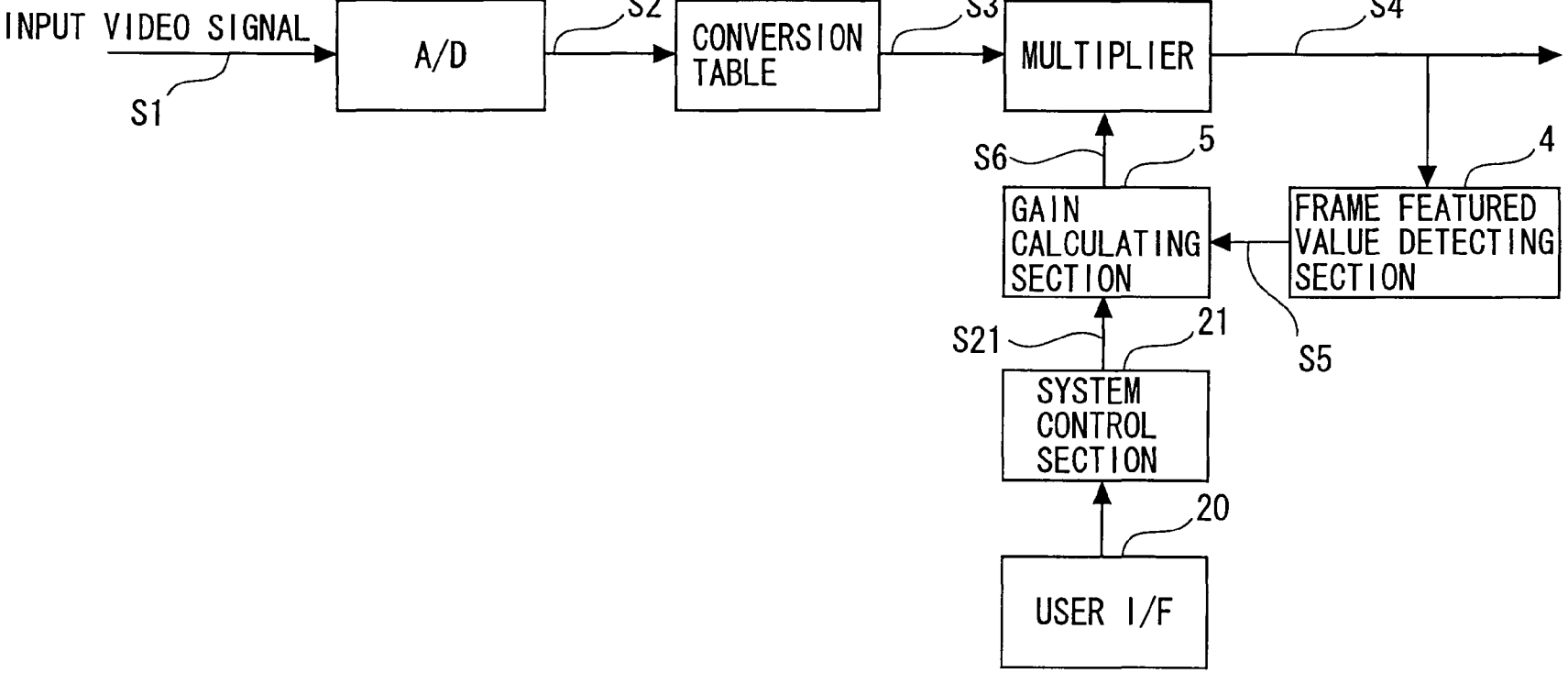
FIG. 5 is a block diagram of a video signal processing apparatus according to a fourth embodiment.

FIG. 5 shows a block diagram of an extracted configuration of a video display apparatus according to a fourth embodiment of the present invention. The whole configuration of the video display apparatus is the same as that in FIG. 2. The same structural elements substantially corresponding to those in FIGS. 1 and 2 are given the same reference symbols and their description will be omitted about them.

In the present embodiment, the gain calculating section 5 is supplied with not only the average brightness signal s5 but also a contrast adjustment signal s21. A contrast adjustment signal s21 as a brightness control value relating to an adjustment of image quality is set using the user interface 20 and is presented to the gain calculating section 5, after being, for example normalized in the system control section 21.

The gain calculating section 5 outputs to the multiplier 3 a smaller value of the gain G(t) obtained in Formula 1 and the contrast adjustment signal s21. Alternatively, the gain calculating section 5 may make multiplication of the gain G and the contrast adjustment signal s21 and output the result.

For a configuration including a low-pass filter as introduced for the second and third embodiments, a brightness adjustment can be carried out likewise by means of inputting of an image quality adjustment signal such as a contrast adjustment signal.

Fifth Embodiment

Figure 6:
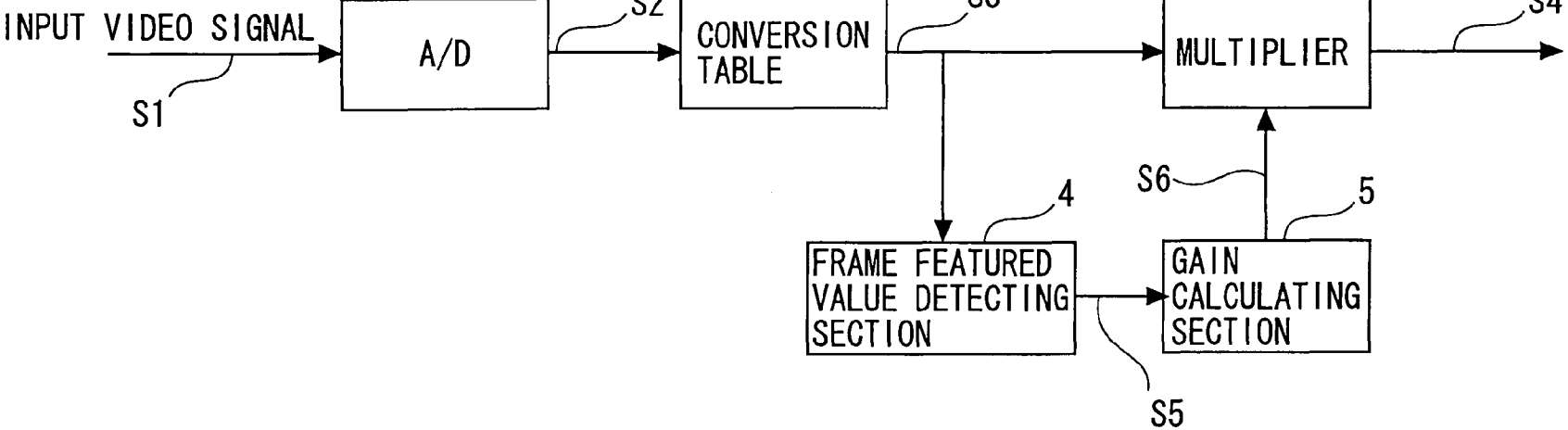
FIG. 6 is a block diagram of a video signal processing apparatus according to a fifth embodiment.
Figure 7:
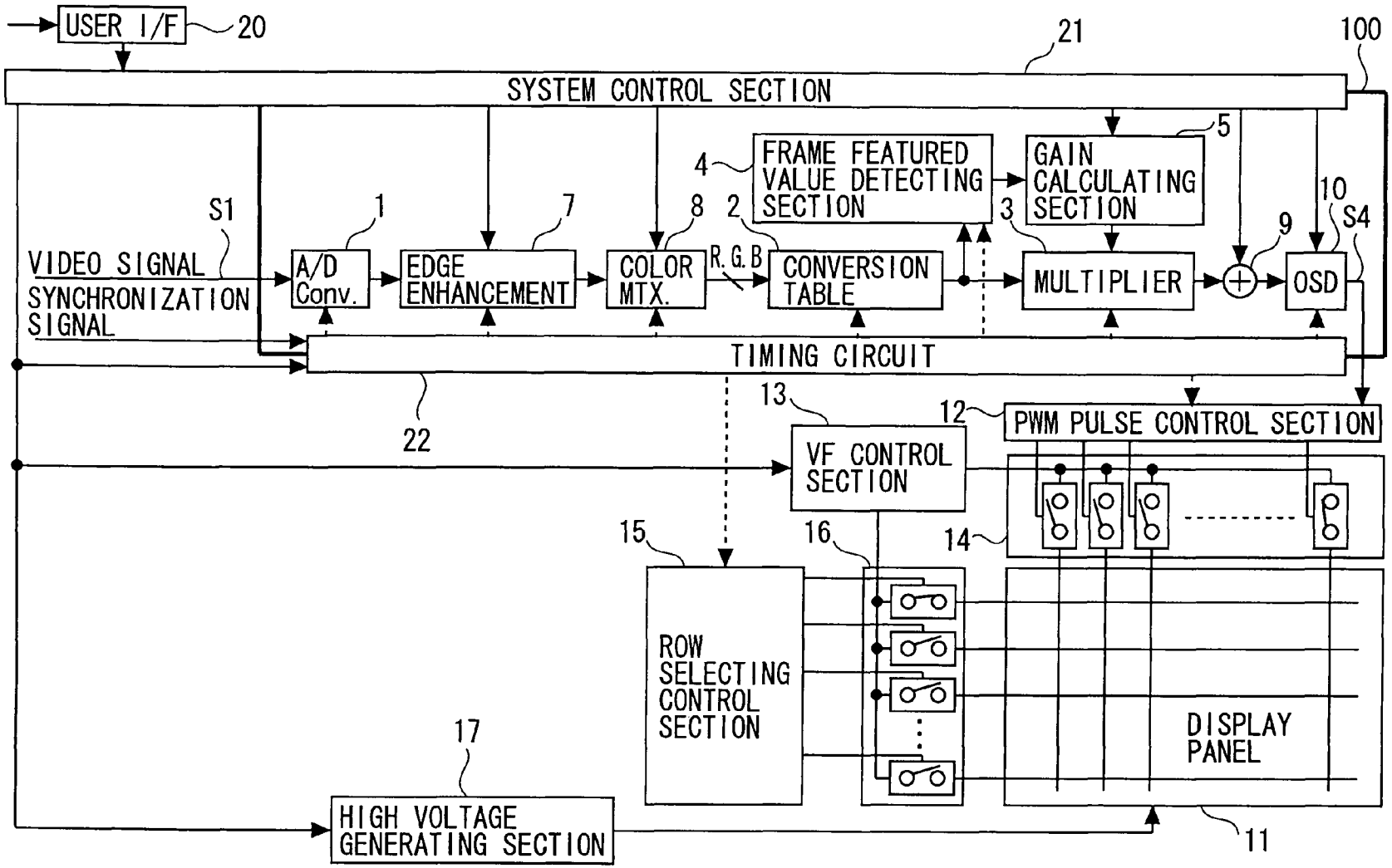
FIG. 7 is an illustration for explaining a configuration of a video display apparatus of the fifth embodiment.

FIG. 6 shows a configuration of a video signal processing apparatus applied to a video display apparatus according to a fifth embodiment of the present invention. FIG. 7 shows a configuration of the whole video display apparatus. Although the order of the constitutional elements in the video signal processing apparatus 100 is different from that in FIG. 2, the constitutional elements are substantially the same as in FIG. 2, and so the same reference symbols are given to them and the description will be omitted.

The present embodiment belongs to a feed-forward control system, and therefore the calculation of gain is based on Formula 4.

[Mathematic Formula 4]

$$G(t)=\mathrm{MIN}(B_0/B(t),1) \quad \text{(Formula 4)}$$

In this way, a good ABL can be realized by simpler operation than in the first embodiment. However, in the case of a configuration of FIG. 7 the frame featured value is detected on a stage before the textual information superimposing circuit 10, and thereby that configuration is suitable for a system in which a displaying area occupied by the textual information and icons to be superimposed on the video signal is small.

It is noted that the order of the constitutional elements in the video signal processing apparatus 100, which is not specified in FIG. 6, is not restricted to that shown in FIG. 6.

Sixth Embodiment

Figure 8:
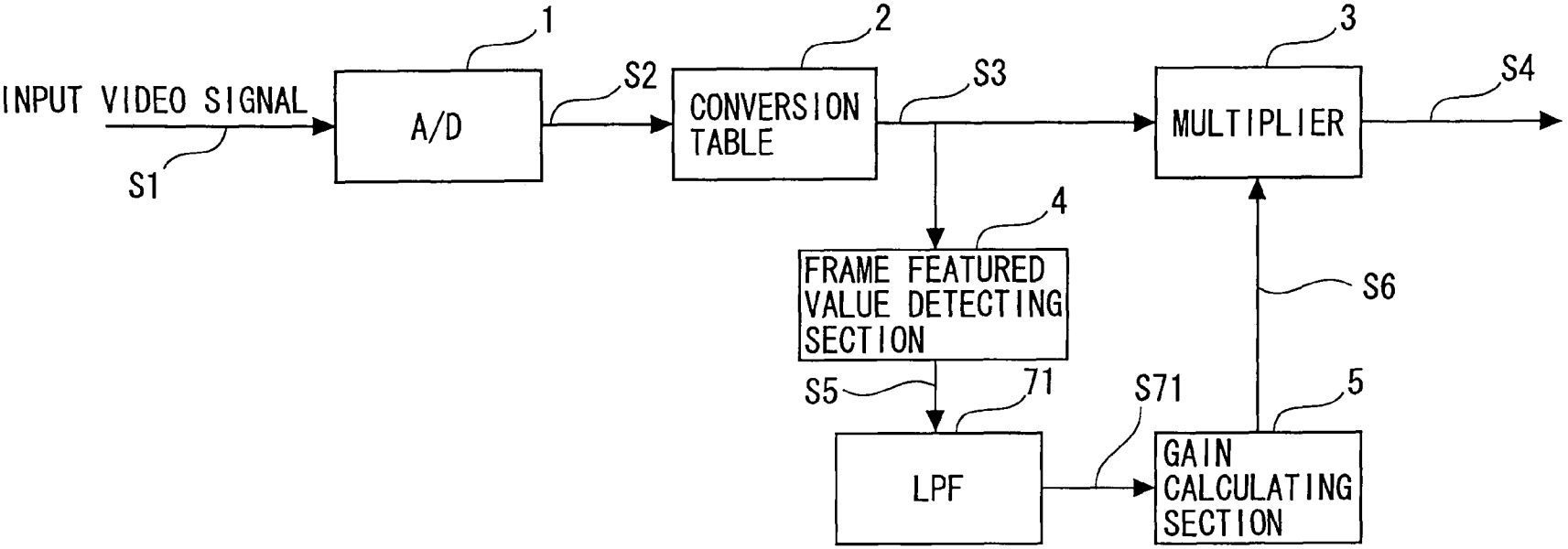
FIG. 8 is a block diagram of a video signal processing apparatus according to a sixth embodiment.

FIG. 8 shows a configuration of a video signal processing apparatus applied to a video display apparatus according to a sixth embodiment of the present invention. Of the configuration of the whole video display apparatus, the configuration other than that of the video signal processing apparatus 100 is the same as in FIG. 7. The same structural features substantially corresponding to those in FIG. 6 are given the same reference symbols and their description will be omitted.

Although the fifth embodiment is adapted to input the output of the frame featured value detecting section 4 to the gain calculating section 5, the present embodiment is arranged to input the average brightness signal s5 to a low-pass filter 71 and input the output s71 to the gain calculating section 5. Here, the low-pass filter 71, gain calculating section 5 and multiplier 3 constitute an adjustment circuit.

The low-pass filter 71 cuts high frequency components of the average brightness signal s5 to suppress the variation of the gain s6 due to precise change of the input video signal in frames, resulting in prevention of visual interference.

In this way, the present embodiment has the above-mentioned advantages by adding the low-pass filter 71 to the video signal processing apparatus 100 according to the fifth embodiment shown in FIG. 6. However, use of the configuration shown in FIG. 6 can also lead to the same results as those in the video signal processing apparatus shown in FIG. 8 by using Formula 5 instead of Formula 4 in the process of the gain calculating section 5.

[Numeral Formula 5]

$$G(t)=\mathrm{MIN}(B_0/f(B),1) \quad \text{(Formula 5)}$$

In this formula, f(x) is a function corresponding to a characteristic of the low-pass filter 71, wherein a plurality of average brightnesses for the past frames to obtain the filtered output.

Seventh Embodiment

Figure 9:
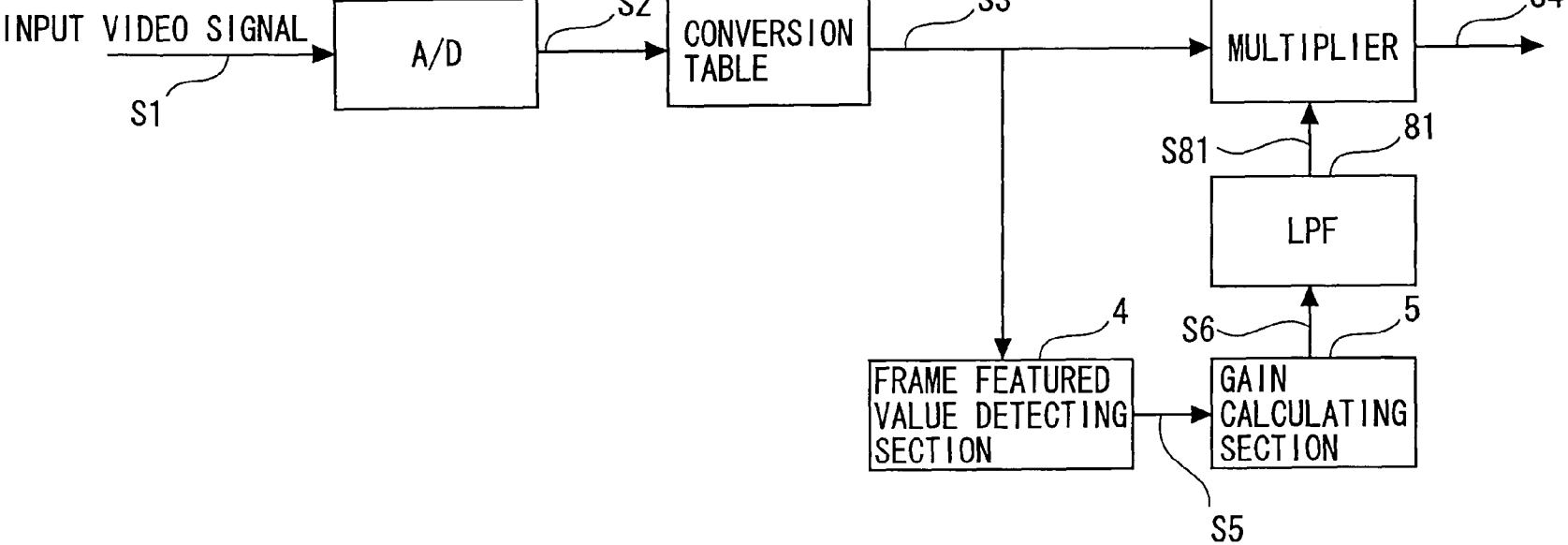
FIG. 9 is a block diagram of a video signal processing apparatus according to a seventh embodiment.

FIG. 9 shows a configuration of a video signal processing apparatus applied to a video display apparatus according to a seventh embodiment of the present invention. Of the configuration of the whole video display apparatus, a configuration other than that of the video signal processing apparatus 100 is the same as that in FIG. 7. The same structural elements substantially corresponding to those in FIG. 6 are given the same reference symbols and the description will be omitted about them.

Although the fifth embodiment is adapted to input the output of the gain calculating section 5 to the multiplier 3, the present embodiment is arranged to input a gain s6 to a low-pass filter 81 and input the output s81 to the multiplier 3. Here, the gain calculating section 5, low-pass filter 71 and multiplier 3 constitute an adjustment circuit.

The low-pass filter 81 cuts high frequency components of the gain s6 to suppress the influence due to precise change of the input video in frames, resulting in prevention of visual interference feeling.

In this way, the present embodiment leads to the above-mentioned advantages by arrangement of adding the low-pass filter 81 to the video signal processing apparatus 100 according to the fifth embodiment shown in FIG. 6. However, use of the configuration shown in FIG. 6 can also lead to the results same as those in the video signal processing apparatus shown in FIG. 9 by using Formula 6 instead of Formula 4 in the process of the gain calculating section 5.

[Numeral Formula 6]

$$G(t)=\mathrm{MIN}(B_0/B(t),1) \quad \text{(Formula 6)}$$

$$G'(t)=f'(G)$$

In this formula, f'(x) is a function corresponding to a characteristic of the low-pass filter 41, wherein a plurality of gains G for the past frames are received and the filtered output is obtained. G'(t) is outputted to the multiplier 3.

Also in the fifth through seventh embodiments, an adjustment signal for image quality such as a contrast adjustment signal may be inputted to carry out the brightness adjustment as with the M-th embodiment.

Eighth Embodiment

Figure 10:
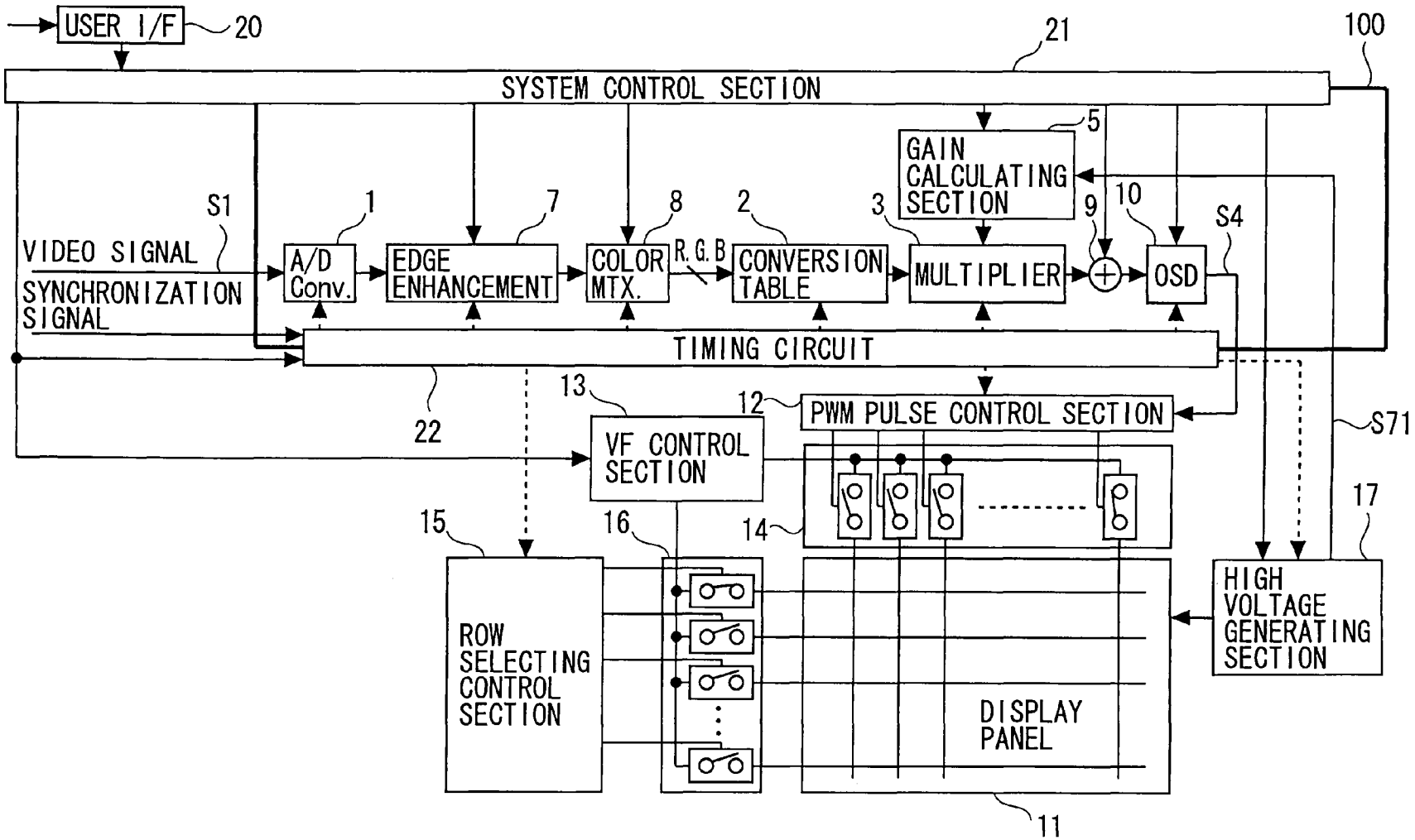
FIG. 10 is a block diagram for explaining a scale of a circuit according to an eighth embodiment.
Figure 11:
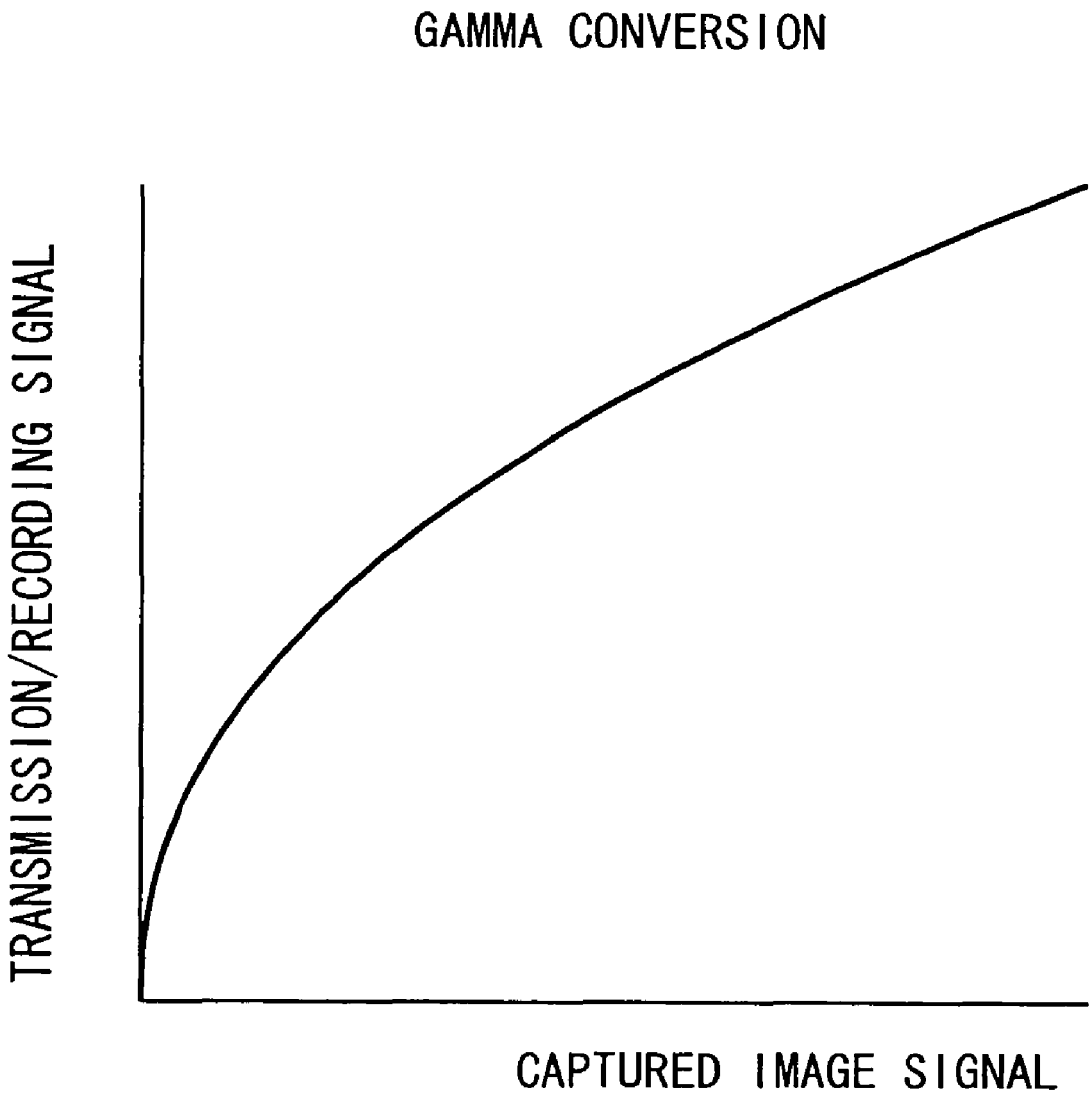
FIG. 11 is a graph for explaining a gamma conversion.

FIG. 10 shows a configuration of a video display apparatus according to an eighth embodiment of the present invention. The same structural elements substantially corresponding to those in FIGS. 1 and 2 are given the same reference symbols and the description will be omitted.

The previously mentioned embodiments provide a disclosure of a configuration in which an average brightness for one frame period is used as a display brightness featured value, which serving as a statistical value for a predetermined period, but the present embodiment provides a configuration in which the high voltage generating section 17 serves as a display brightness featured value detecting circuit and generates a high voltage current value signal s71 as a display brightness featured value. In other words, instead of the average brightness signal s5 in the previously mentioned embodiments, a high voltage current value signal s71 obtained from the high voltage generating section 17 is inputted to the gain calculating section 5 as a display brightness featured value. The high voltage current increases or decreases substantially in proportion to the amount of emitted light in the case of an SED panel, and thereby it is possible to suitably use the high voltage current signal s71 having a value of emitted current emitted from an electro-emission element as a measure of the average brightness. The processing after the gain calculating section 5 is the same as that in the first embodiment.

Furthermore, the gain may be calculated by low-pass filtering the high voltage current value signal s71, and the calculated gain may be subjected to the low-pass filtering to thereafter input the result to the multiplier 3. A statistical value for the high voltage current values for a predetermined period may be outputted as a display brightness featured value to the gain calculating section.

According to the present embodiment, since the actual high voltage current is used as a measure of an average brightness, accurate brightness estimate value can be obtained and quickly reach the final value. Therefore, a good ABL control is possible even in the case of a moving image that makes variation of an average brightness successively.

In the embodiments described above, it is possible to acquire an accurate average brightness information to realize video displaying with a good ABL control.

As described above, according to the present invention, a preferred adjustment of image can be realized in a video display apparatus that performs nonlinear conversion.

What is claimed is:

1. A video display apparatus comprising:

a display panel;

a converting circuit for executing nonlinear conversion for an input video signal to output a converted video signal;

a display brightness featured value detecting circuit for detecting a display brightness featured value indicating a brightness of a display screen;

an adjustment circuit for adjusting the converted video signal on the basis of said display brightness featured value to output an adjusted video signal; and a superimposing circuit for superimposing a signal for displaying textual information or an icon on the adjusted video signal to output a superimposed video signal to the display panel, wherein said display brightness featured value detecting circuit receives the superimposed video signal output from said superimposing circuit and calculates the display brightness featured value from the superimposed video signal in which textual information or an icon is superimposed thereon, and the adjustment circuit adjusts the converted video signal based on the calculated display brightness featured value such that the textual information or the icon is not adjusted based on the calculated display brightness featured value, and wherein an image is displayed on the basis of the superimposed video signal output from said superimposing circuit.

2. A video display apparatus as defined in claim 1, wherein said adjustment circuit is an adjustment circuit for adjusting the converted video signal on the basis of a plurality of display brightness featured values which are sequentially detected.

3. A video display apparatus as defined in claim 1, wherein said adjustment circuit is also an adjustment circuit for adjusting the converted video signal on the basis of a brightness control value relating to an adjustment of image quality.

4. A video display apparatus as defined in claim 1, wherein said display brightness featured value is an average value of display signals for a predetermined period.

5. A video display apparatus as defined in claim 1, wherein said display brightness featured value is the number of signals of the display signals for a predetermined period which have a greater value than a predetermined value.

6. A video display apparatus as defined in claim 1, wherein said display brightness featured value is a sum or average value of display signals for each color for a predetermined period.

7. A video display apparatus as defined in claim 1, wherein said display brightness featured value is an average value of brightness components of display signals for a predetermined period.

8. A video display apparatus as defined in claim 1, wherein said display brightness featured value is a statistical value of display signals in a specific area of one display screen.

9. A video display apparatus as defined in claim 1, wherein pixels of said video display apparatus are constructed of display elements arranged in matrix.

* * * * *